US006155046A

United States Patent [19]

Kato et al.

[11] Patent Number: 6,155,046

[45] Date of Patent: Dec. 5, 2000

[54] HEAT-INSULATION TYPE EXHAUST MANIFOLD

[75] Inventors: Seiji Kato; Koichi Fujimori; Kazuo Ishii; Takashi Komatsuda; Hiroshi Hashimoto; Tatsumi Yamada, all of Wako; Kazuhiro Furuhashi, Hamamatsu, all of Japan

[73] Assignee: Honda Giken Kogyo Kabushiki Kaisha, Tokyo, Japan

[21] Appl. No.: 09/293,957

[22] Filed: Apr. 19, 1999

[30] Foreign Application Priority Data

| | | | |
|---|---|---|---|
| Apr. 20, 1998 | [JP] | Japan | 10-109770 |
| Apr. 20, 1998 | [JP] | Japan | 10-109772 |
| Apr. 20, 1998 | [JP] | Japan | 10-109773 |

[51] Int. Cl.[7] ..... F01N 7/10

[52] U.S. Cl. ..... 60/323; 60/322

[58] Field of Search ..... 60/322, 323, 282, 60/272

[56] References Cited

U.S. PATENT DOCUMENTS

| | | | |
|---|---|---|---|
| 4,037,408 | 7/1977 | Ozawa | 60/282 |
| 5,606,857 | 3/1997 | Harada | 60/322 |
| 5,953,912 | 9/1999 | Kaiho et al. | 60/323 |

FOREIGN PATENT DOCUMENTS 9-280046 10/1997 Japan .

*Primary Examiner*—Thomas Denion
*Assistant Examiner*—Binh Tran
*Attorney, Agent, or Firm*—Arent Fox Kintner Plotkin & Kahn, PLLC

[57] ABSTRACT

An exhaust manifold M is comprised of a plurality of inner exhaust pipe shells secured to an upper flange, and a plurality of outer exhaust pipe shells secured to the upper flange to individually cover the inner exhaust pipe shells, wherein a downstream end of each of the corresponding inner exhaust pipe shells slidably contacts an annular bead bulging from an outer peripheral surface of the downstream end of the outer exhaust pipe shells. An inner collecting pipe shell communicates with the plurality of inner exhaust pipe shells and is secured at its upstream end to the plurality of outer exhaust pipe shells, and an outer collecting pipe shell which is secured at its upstream end to the plurality of outer exhaust pipe shells covers the inner collecting pipe shell. A downstream end of the inner collecting pipe shell slidably contacts an annular mesh member interposed therebetween. Sliding portions for absorbing a difference in the axial thermal elongation between inner and outer double walls are provided separately at the downstream end of an exhaust single pipe and the downstream end of an exhaust collecting pipe. Thus, the sliding stroke in each of the sliding portions can be set to a small value, and the absorption of the thermal elongation can be carried out smoothly.

13 Claims, 11 Drawing Sheets

HEAT-INSULATION TYPE EXHAUST MANIFOLD

BACKGROUND OF THE INVENTION

1. Field of the Invention

The present invention relates to an improvement in a heat-insulation type exhaust manifold for an engine, which includes an upper flange, a plurality of exhaust single pipes coupled at their upstream ends to the upper flange, an exhaust collecting pipe coupled to the downstream ends of the exhaust single pipes, and a lower flange coupled to the downstream end of the exhaust collecting pipe, each of the pipes being formed in a double-wall fashion.

2. Description of the Prior Art

There is a conventionally known heat-insulation type exhaust manifold, for example, as disclosed in Japanese Patent Application Laid-open No. 9-280046, which is comprised of an upper flange, a plurality of exhaust single pipes coupled at their upstream ends to the upper flange, an exhaust collecting pipe coupled to the downstream ends of the exhaust single pipes and communicating with the exhaust single pipes, a common outer pipe which covers the plurality of exhaust single pipes and the exhaust collecting pipe and which is coupled at its upstream end to the upper flange, and a lower flange coupled to the downstream end of the outer pipe. The downstream end of the exhaust gas collecting pipe is slidably carried on an inner peripheral surface of the outer pipe. The difference in axial thermal elongation between the exhaust single pipes as well as the exhaust collecting pipe and the outer pipe is absorbed by the sliding movement between the exhaust gas collecting pipe and the outer pipe, so that a thermal strain is prevented from being produced in each of respective portions to the utmost.

In the above known exhaust manifold, however, the plurality of exhaust single pipes are integrally coupled to the exhaust collecting pipe. For this reason, all the thermal elongation of each of the exhaust single pipes is concentrated in the sliding portions of the exhaust collecting pipe and the outer pipe, and a large sliding stroke must be ensured in the sliding portions. However, if the sliding stroke is increased, there is a possibility that an inclination occurs between the sliding portions in the sliding course and as a result, a thermal strain is liable to be produced.

SUMMARY OF THE INVENTION

Accordingly, it is an object of the present invention to provide a heat-insulation type exhaust manifold for an engine, wherein the difference in axial thermal elongation between the inner and outer double walls can be absorbed with a relative small sliding stroke.

To achieve the above object, according to a first aspect and feature of the present invention, there is provided a heat-insulation type exhaust manifold in an engine, comprising an upper flange, a plurality of exhaust single pipes coupled at the upstream ends thereof to the upper flange, at least one exhaust collecting pipe coupled to the downstream ends of the exhaust single pipes, and a lower flange coupled to the downstream end of the exhaust collecting pipe, each of the exhaust single pipes and the exhaust collecting pipe being formed in a double-wall structure. Each of the exhaust single pipes is comprised of an inner exhaust pipe shell and an outer exhaust pipe shell, the inner exhaust pipe shell is disposed within the outer exhaust pipe shell, the upstream ends of the inner and outer exhaust pipe shells being coupled to each other and to the upper flange. The inner exhaust pipe shell is slidably in contact with, at its downstream end, an inner peripheral surface of the outer pipe shell. The exhaust collecting pipe comprises an inner collecting pipe shell communicating with the plurality of inner pipe shells, and an outer collecting pipe shell covering the inner collecting pipe shell, the upstream ends of the inner and outer collecting pipe shells being coupled to each other and to the plurality of the outer exhaust pipe shells, the inner collecting pipe shell being slidably carried at the downstream end thereof with an inner peripheral surface of the outer collecting pipe shell. The lower flange is coupled to a downstream end of the outer collecting pipe shell.

With the first feature, a difference in thermal elongation between the inner and outer exhaust pipe shells can be absorbed by the sliding movement of the inner and outer exhaust pipe shells relative to each other, and a difference in thermal elongation between the inner and outer collecting pipe shells can be absorbed by the sliding movement of the inner and outer collecting pipe shells relative to each other. By providing the sliding portions for absorbing the difference in axial thermal elongation between the inner and outer double walls separately at the downstream end of the exhaust single pipes and the downstream end of each of the exhaust collecting pipe in the heat-insulation type exhaust manifold in the above manner, the sliding stroke at each of the sliding portions can be set at a smaller level, so that an inclination between the sliding portions does not occur or is minimized during sliding movement of the sliding portions. Thus, it is possible to effectively prevent the generation of thermal strain in each of the portions of the exhaust manifold, thereby providing an enhanced durability of the exhaust manifold.

According to a second aspect and feature of the present invention, the inner exhaust pipe shell has a projection formed at the downstream end thereof, the projection bulging from an outer peripheral surface of the downstream end of the inner exhaust pipe shell and slidably contacting the inner peripheral surface of the corresponding outer exhaust pipe shell.

With the second feature, the downstream end of the inner exhaust pipe shell can slidably contact the outer exhaust pipe shell, while ensuring a heat insulating space between the inner and outer exhaust pipe shells without use of a special member, only by bulging the projection from the outer peripheral surface of the downstream end of the inner exhaust pipe shell.

According to a third aspect and feature of the present invention, the projection is an annular bead having an increased diameter buldging from the outer peripheral surface of the inner exhaust pipe shell by increasing the diameter of the inner exhaust pipe shell.

With the third feature, the rigidity of the downstream end of the inner exhaust pipe shell can be effectively increased by the annular bead bulging from the outer peripheral surface. Moreover, the bead slidably contacts the inner peripheral surface of the outer exhaust pipe shell and hence, even if a pulsation of pressure occurs in exhaust gas passing through the inner exhaust pipe shell, it is possible to prevent chatter due to the vibration from being produced at the contacting portion, and to absorb the difference in axial thermal elongation between the inner and outer exhaust pipe shells by the sliding movement of the annular bead relative to the inner peripheral surface of the outer exhaust pipe shell to thereby prevent thermal strain in each of various portions of the inner and outer exhaust pipe shells. Thus, it is possible to reduce the wall thickness of the inner exhaust pipe shell to thereby reduce the heat mass of the inner exhaust pipe shell, thus preventing the drop in the temperature of the exhaust gas, and contributing to a reduction in weight of the exhaust manifold.

According to a fourth aspect and feature of the present invention, the outer exhaust pipe shell has a projection formed on the downstream end thereof, the projection bulging form the inner peripheral surface of the downstream end to contact the outer peripheral surface of the corresponding inner exhaust pipe shell for sliding movement between the inner and outer exhaust pipe shells.

With the fourth feature, the downstream end of the inner exhaust pipe shell can slidably contact the outer exhaust pipe shell, while ensuring a heat insulating space between the inner and outer exhaust pipe shells without the use of a special member, only by bulging the projection on the inner peripheral surface of the downstream end of the outer exhaust pipe shell.

According to a fifth aspect and feature of the present invention, the number of the projections is at least three, the at least three projections being arranged at substantially equal distances circumferentially around the outer exhaust pipe shell.

With the fifth feature, spaces exist between the projections and hence, a difference in circumferential thermal elongation between the inner and outer exhaust pipe shells, can be absorbed in the spaces.

According to a sixth aspect and feature of the present invention, the at least three projections are disposed offset from one another in the axial direction of the outer exhaust pipe shell.

With the sixth feature, no other projection exists on the circumference of the outer exhaust pipe shell including the projections. Therefore, even if the peripheral wall of the inner exhaust pipe shell is urged by each of the projections during formation of each of the projections, the inner pipe shell can be in the urging direction without being restrained by the other projection, thereby avoiding the recessed deformation of the peripheral wall of the inner exhaust pipe shell by the projections. Therefore, it is possible to prevent a useless increase in resistance to the sliding movement of the inner exhaust pipe shell relative to the projections of the outer exhaust pipe shell, to thereby smoothly absorb the difference in axial thermal elongation between the inner and outer exhaust pipe shells.

According to a seventh aspect and feature of the present invention, the outer exhaust pipe shell has a projection formed on a bent outer peripheral wall in an intermediate bent portion thereof, and bulging form the inner surface of the outer peripheral wall to contact a bent outer peripheral surface of an intermediate bent portion of the corresponding inner exhaust pipe shell for sliding movement between the inner and outer exhaust pipe shells.

With the seventh feature, the inner exhaust pipe shell can be slid relative to the projection of the outer exhaust pipe shell by means of a difference in the axial thermal elongation between those portions of the inner and outer exhaust pipe shells which are upstream from the intermediate bent portions, thereby ensuring a defined heat-insulating space between the inner and outer exhaust pipe shells.

According to an eighth aspect and feature of the present invention, the downstream end of the inner collecting pipe shell is slidably carried on the inner peripheral surface of the outer collecting pipe shell with the mesh member interposed therebetween.

With the eighth feature, the difference in thermal elongation between the inner and outer collecting pipe shells can be absorbed by the relative sliding movement of the inner and outer collecting pipe shells through the mesh member, and the difference in circumferential thermal elongation between the relatively large-diameter downstream ends of the inner and outer collecting pipe shells can be absorbed by the compressive deformation of the mesh member. Further, the mesh member is capable of suppressing the vibration of the free end, i.e., downstream end of the inner exhaust pipe shell to avoid the generation of noise due to vibration.

According to a ninth aspect and feature of the present invention, the mesh member is bonded to an outer peripheral surface of the downstream end of the inner collecting pipe shell.

With the ninth feature, the mesh member can be reliably retained at a fixed location between the inner and outer collecting pipe shells.

According to a tenth aspect and feature of the present invention, the annular mesh member is slidably mounted in an annular recess defined in the inner peripheral surface of the downstream end of the outer collecting pipe shell to contact an outer peripheral surface of the inner collecting pipe shell for sliding movement.

With the tenth feature, the difference in axial thermal elongation between the inner and outer exhaust pipe shells can be absorbed by the relative sliding movement of the inner exhaust pipe shell and the mesh member and the relative sliding movement of the outer exhaust pipe shell and the mesh member. Therefore, even if sliding movement does not occur in one of the sliding portions due to biting of foreign matter, the absorption of the difference in axial thermal elongation can be performed without hindrance by the operation of the other sliding portion, thereby enhancing the durability of the exhaust manifold. Moreover, when both of the sliding portions are operated normally, the difference in axial thermal elongation between the inner and outer collecting pipe shells is shared by both of the sliding portions. Therefore, the amount of sliding movement of each of the sliding portions is reduced by half, as compared with the case where there is only one sliding portion. This can contribute to an enhancement in durability of the mesh member.

According to an eleventh aspect and feature of the present invention, the inner exhaust pipe shell is comprised of a pair of inner collecting pipe shell halves bonded at their opposed ends to each other, and the mesh member is comprised of a pair of arcuate mesh member pieces which are disposed annularly out of contact with the bonded ends of the inner collecting pipe shell halves.

With the eleventh feature, the mesh member can be easily disposed between the inner and outer collecting pipe shells, while avoiding interference with the bonded ends of the inner collecting pipe shell halves, whereby the relative sliding movement of the inner and outer collecting pipe shells can be carried out smoothly.

The above and other objects, features and advantages of the invention will become apparent from the following description of the preferred embodiment taken in conjunction with the accompanying drawings.

DETAILED DESCRIPTION OF THE PREFERRED EMBODIMENTS

A first embodiment of the present invention will be first described below with reference to FIGS. 1 to 6.

Figure 1:
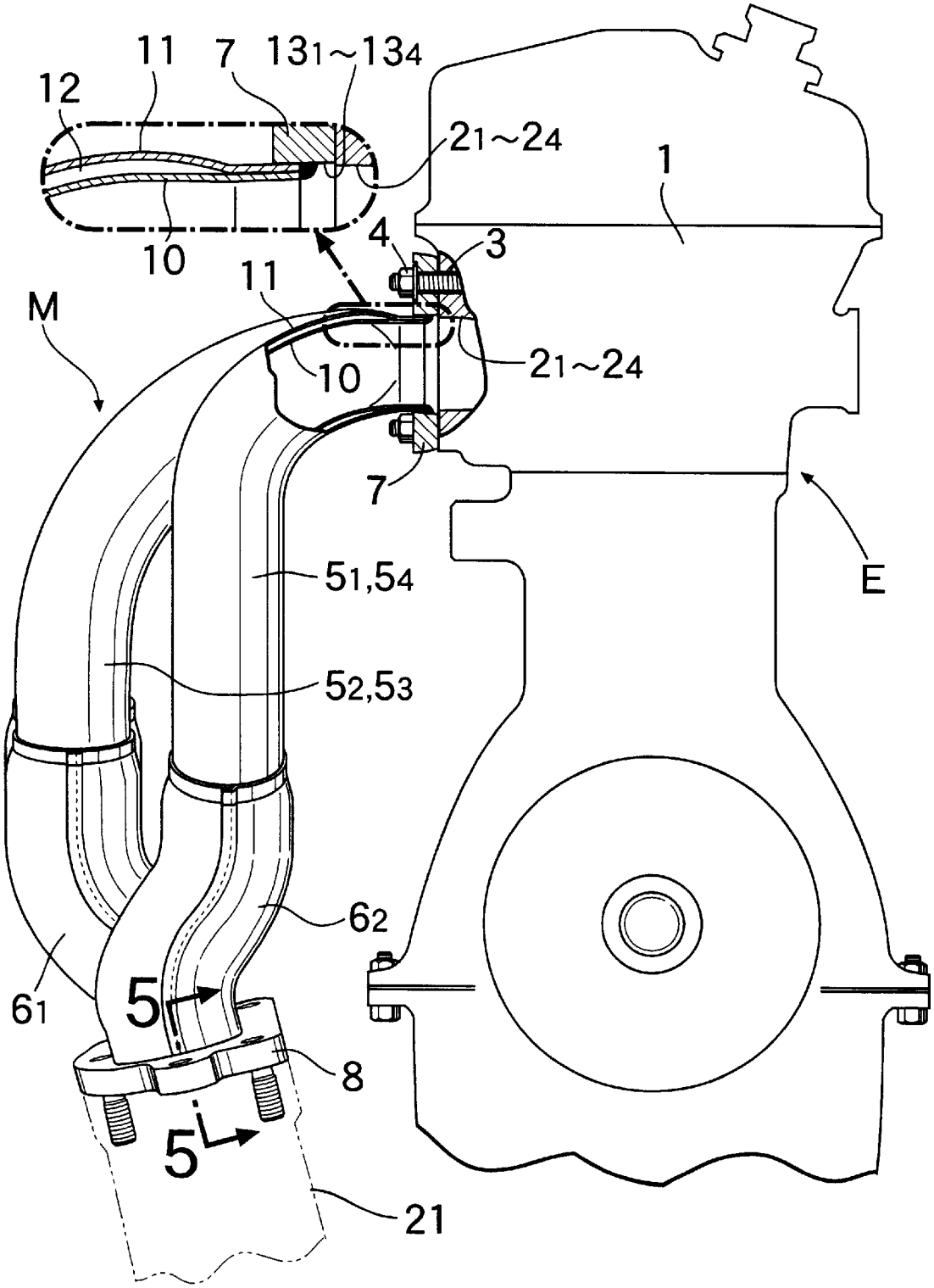
FIG. 1 is a side view of an engine including a heat-insulation type exhaust manifold according to a first embodiment of the present invention.

Referring to FIG. 1, four exhaust ports $\mathbf{2}_1$, $\mathbf{2}_2$, $\mathbf{2}_3$ and $\mathbf{2}_4$ are provided to open into a front surface of a cylinder head 1 of a 4-cylinder engine E in correspondence to the cylinders. A heat-insulation type exhaust manifold M according to the present invention for guiding an exhaust gas discharged from the exhaust ports $\mathbf{2}_1$, $\mathbf{2}_2$, $\mathbf{2}_3$ and $\mathbf{2}_4$, is mounted on the cylinder head 1 by a plurality of stud bolts 3 and nuts 4.

Figure 2:
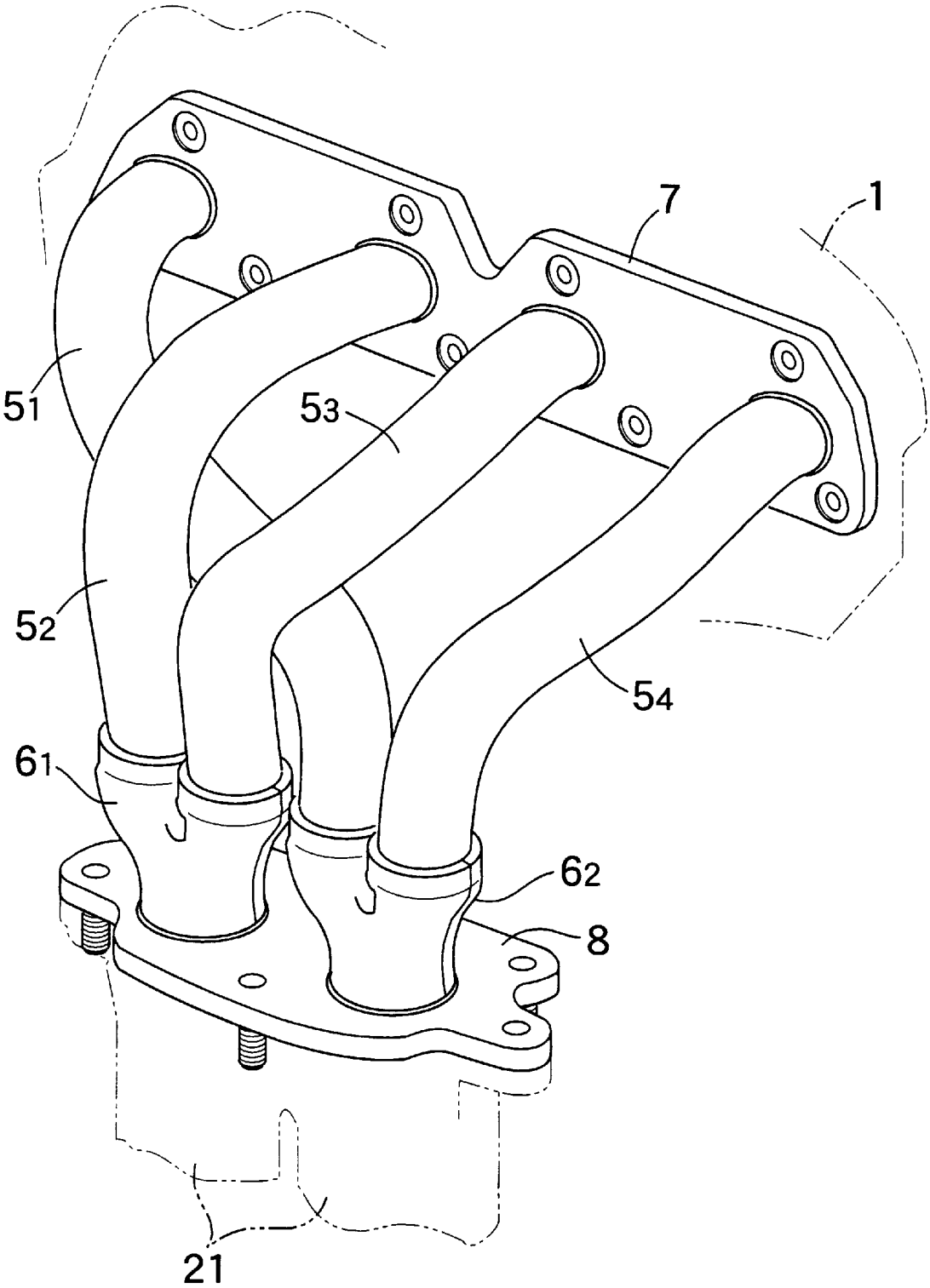
FIG. 2 is a perspective view of the exhaust manifold.
Figure 3:
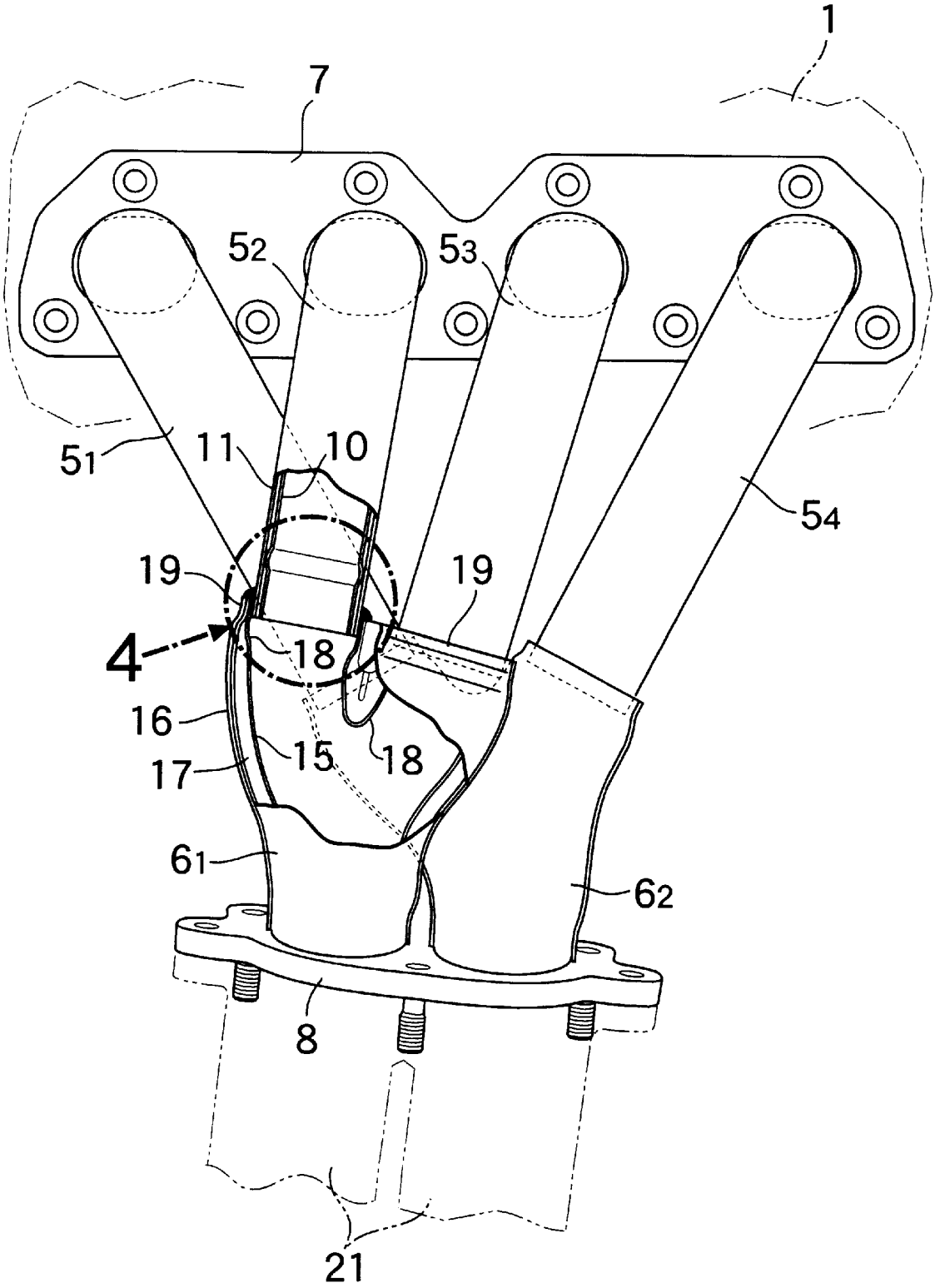
FIG. 3 is a front view of the exhaust manifold with a portion being sectioned vertically.
Figure 4:
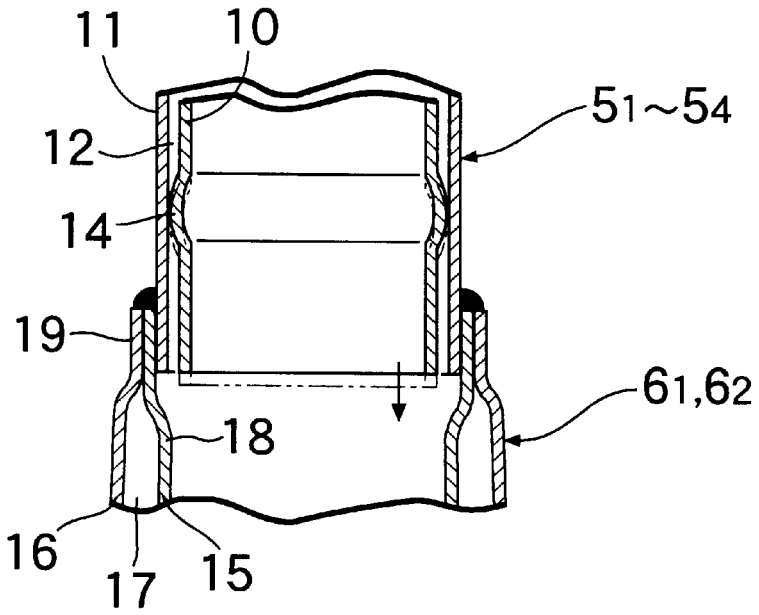
FIG. 4 is an enlarged view of a portion indicated by 4 in FIG. 3.

As shown in FIGS. 2 to 4, the exhaust manifold M includes four exhaust single pipes $\mathbf{5}_1$, $\mathbf{5}_2$, $\mathbf{5}_3$ and $\mathbf{5}_4$ which individually communicate with the four exhaust ports $\mathbf{2}_1$, $\mathbf{2}_2$, $\mathbf{2}_3$ and $\mathbf{2}_4$ and which will be called first, second, third and fourth exhaust single pipes starting from the left side in FIG. 3.

An upper flange 7 is connected to the upstream ends of the first to fourth exhaust single pipes $\mathbf{5}_1$ to $\mathbf{5}_4$. A first exhaust collecting pipe $\mathbf{6}_2$ is connected to the downstream ends of the second and third exhaust single pipes $\mathbf{5}_2$ and $\mathbf{5}_3$, and a second exhaust collecting pipe $\mathbf{6}_2$ is connected to the downstream ends of the first and fourth exhaust single pipes $\mathbf{5}_1$ and $\mathbf{5}_4$. A lower flange 8 is connected to the downstream ends of the first and second exhaust collecting pipes $\mathbf{6}_1$ and $\mathbf{6}_2$. The upper flange 7 is secured to the cylinder head 1 by the stud bolts 3 and the nuts 4, and an intermediate exhaust simple pipe 21 connected to a common catalytic converter (as an exhaust emission control device) (not shown) disposed below a floor of a vehicle, is connected to the lower flange 8. It should be noted that the catalytic converter may be connected directly to the lower flange 8.

Each of the exhaust single pipes $\mathbf{5}_1$ to $\mathbf{5}_4$ is comprised of an inner exhaust pipe shell 10 and an outer exhaust pipe shell 11 which are disposed in a double-wall fashion, and a cylindrical heat-insulating space 12 is defined between the inner and outer exhaust pipe shells 10 and 11. The inner exhaust pipe shell 10 is made of a thin stainless steel pipe, and the outer exhaust pipe shell 11 is also made of a stainless steel pipe, but thicker than the inner exhaust pipe shell 10.

The upstream end of the outer exhaust pipe shell 11 is reduced in diameter, so that it is fitted over an outer peripheral surface of the upstream end of the inner exhaust pipe shell 10. The upstream ends of the inner and outer pipe shells are fitted into through-bores $\mathbf{13}_1$ to $\mathbf{13}_4$ provided in the upper flange 7 and connected to the corresponding exhaust ports $\mathbf{2}_1$ to $\mathbf{2}_4$, and are secured to inner peripheral surfaces of the through-bores $\mathbf{13}_1$ to $\mathbf{13}_4$ by welding (see FIG. 1).

An annular projection 14 arcuate in cross section, i.e., an annular bead 14 is formed at the downstream end of the inner exhaust pipe shell 10 to bulge from the outer peripheral surface by an increase in the diameter from the inner periphery. This annular bead 14 slidably contacts the inner peripheral surface of the outer exhaust pipe shell 11. In this manner, the downstream end of the inner exhaust pipe shell 10 is slidably contact with the outer exhaust pipe shell 11.

Each of the exhaust gas collecting pipes $\mathbf{6}_1$ and $\mathbf{6}_2$ is comprised of an inner collecting pipe shell 15 and an outer collecting pipe shell 16 which are disposed in a double-wall fashion, and a heat-insulating space 17 is also defined between the inner and outer pipe shells 15 and 16. The inner collecting pipe shell 15 is formed by overlapping opposed ends of a pair of inner collecting pipe shell halves 15*a* and 15*b* made of a thin stainless steel plate onto each other and welding the entire overlapped portions. During this time, inner bifurcated pipe portions 18, 18 are formed at the upstream end of the inner collecting pipe shell 15, and the downstream ends of the corresponding two outer exhaust pipe shells 11, 11 are fitted into the inner bifurcated pipe portions 18, 18.

The outer collecting pipe shell 16 is also formed by overlapping opposed ends of a pair of outer collecting pipe shell halves 16*a* and 16*b* made of a stainless steel plate onto each other and welding the entire overlapped portions. The outer collecting pipe shell has a thickness larger than that of the inner collecting pipe shell 15. Outer bifurcated pipe portions 19, 19 are formed at the upstream end of the outer collecting pipe shell 16 to cover the inner bifurcated pipe portions 18, 18, respectively. The tip ends of the outer bifurcated pipe portions 19, 19 are reduced in diameter, so that they are fitted over outer peripheral surfaces of the inner bifurcated pipe portions 18, 18, and such fitted portions are secured to the outer peripheral surfaces of the downstream ends of the corresponding outer exhaust pipe shells 11, 11 by welding.

Figure 5:
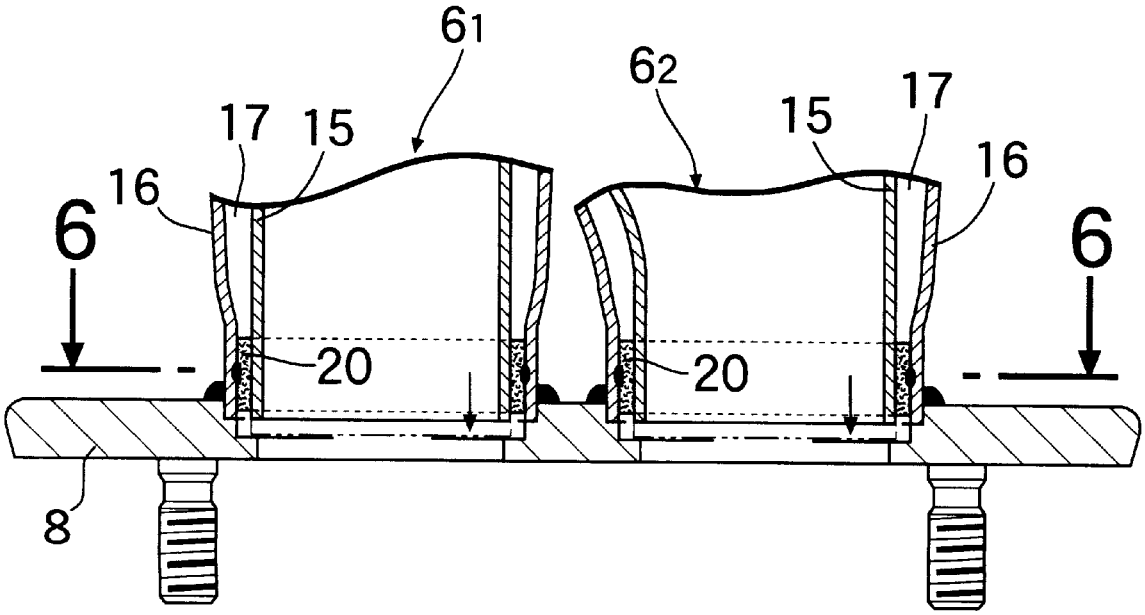
FIG. 5 is a sectional view taken along a line 5—5 in FIG. 1.
Figure 6:
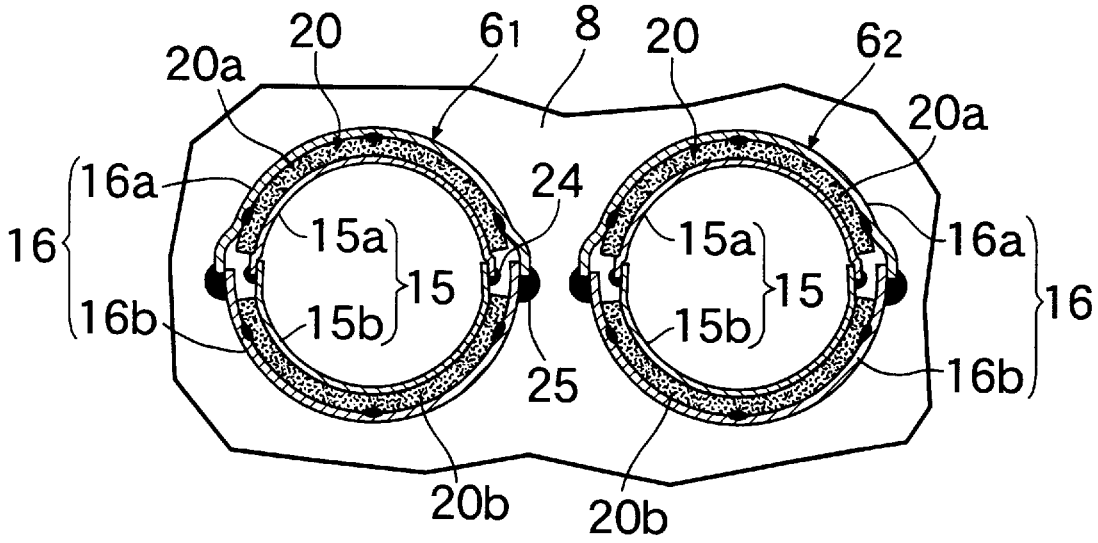
FIG. 6 is a sectional view taken along a line 6—6 in FIG. 5.

As shown in FIGS. 5 and 6, the lower flange 8 is secured to the downstream end of the outer collecting pipe shell 16 by welding. An annular mesh member 20 made of a knitted stainless wire, is attached to the inner peripheral surface of the downstream end of the outer collecting pipe shell 16 by welding, and the downstream end of the inner collecting pipe shell 15 is slidably fitted to the inner peripheral surface of the mesh member 20. In this manner, the downstream end of the inner collecting pipe shell 15 is slidably carried at the outer collecting pipe shell 16 with the mesh member 20 interposed therebetween. The mesh member 20 comprises a pair of arcuate mesh member pieces 20*a* and 20*b* disposed annularly. The weld zone 24 of the inner collecting pipe shell halves 15*a* and 15*b* and the weld zone 25 of the outer collecting pipe shell halves 16*a* and 16*b* are disposed between mesh member pieces 20*a* and 20*b*.

The operation of the first embodiment will be described below.

During operation of the engine E, an exhaust gas is discharged from the four exhaust ports $2_1$, $2_2$, $2_3$ and $2_4$ sequentially into the first exhaust single pipe $5_1$, the second exhaust single pipe $5_2$, the fourth exhaust single pipe $5_4$ and the exhaust single pipe $5_3$. The exhaust gas flow passing through the first and fourth exhaust single pipes $5_1$ and $5_4$ are joined together in the first exhaust collecting pipe $6_1$, and the exhaust gas flow passing through the second and third exhaust single pipes $5_2$ and $5_3$ are joined together in the second exhaust collecting pipe $6_2$. Thereafter, the exhaust gas flows are joined together in the intermediate exhaust simple pipe 21 and guided into the common catalytic converter (not shown), where the exhaust gas is purified.

Each of the exhaust single pipes $5_1$ to $5_4$ is comprised of the inner and outer exhaust pipe shells 10 and 11 disposed in the double-wall fashion. The inner exhaust pipe shell 10 is formed with a smaller wall thickness, and the heat-insulating space 12 is defined between the inner and outer exhaust pipe shells 10 and 11. Each of the exhaust collecting pipes $6_1$ and $6_2$ is also comprised of the inner and outer collecting pipe shells 15 and 16 disposed in the double-wall fashion. The inner collecting pipe shell 15 is formed with a smaller wall thickness, and the heat-insulating space 17 is also defined between the inner and outer collecting pipe shells 15 and 16. Therefore, the inner exhaust pipe shell 10 and the inner collecting pipe shell 15 each having a smaller heat mass, are heated by the higher-temperature exhaust gas flowing therein and promptly rise in temperature. This temperature is maintained by the heat-insulating spaces 12 and 17. Therefore, in the subsequent exhaust gas flow, the dropping of its temperature is suppressed, and the gas flow can be guided to the catalytic converter, whereby the activation of the catalytic converter can be promoted to enhance the efficiency of purification of the exhaust gas.

During this time, a larger axial thermal elongation of the inner exhaust pipe shell 10 is produced compared with that of the outer exhaust pipe shell 11. However, as the elongation is produced, the annular bead 14 on the outer peripheral surface of the downstream end of the inner exhaust pipe shell 10 slides relative to the inner peripheral surface of the outer exhaust pipe shell 11 which contacts the annular bead 14, whereby the difference in axial thermal elongation between the inner and outer exhaust pipe shells 10 and 11 is absorbed.

Even in each of the exhaust collecting pipes $6_1$ and $6_2$, a larger axial thermal elongation of the inner collecting pipe shell 15 is produced compared with that of the outer collecting pipe shell 16. However, as the elongation is produced, the downstream end of the inner collecting pipe shell 15 slides relative to the annular mesh member 20 carried on the outer collecting pipe shell 16, whereby the difference in axial thermal elongation between the inner and outer collecting pipe shells 15 and 16 is absorbed. Each of the downstream ends of the inner and outer collecting pipe shells 15 and 16 is of a relatively large diameter and hence, the difference in circumferential thermal elongation between the inner and outer collecting pipe shells 15 and 16 cannot be ignored, but is absorbed by the compressive deformation of the mesh member 20. Further, the mesh member 20 is capable of suppressing the vibration of the free end, i.e., the downstream end of the inner exhaust pipe shell 10, to thereby avoid the generation of noise due to the vibration.

By providing the sliding portions for absorbing the difference in axial thermal elongation between the inner and outer double walls separately at the downstream end of each of the exhaust single pipes $5_1$ to $5_4$ and the downstream end of each of the exhaust collecting pipes $6_1$ and $6_2$ in the heat-insulation type exhaust manifold M in the above manner, the sliding stroke at each of the sliding portions can be set at a smaller level, so that the inclination between the sliding portions does not or only minimally occurs during the sliding movement of the sliding portions. Thus, it is possible to effectively prevent the generation of a thermal strain in each of portions of the exhaust manifold M, thereby providing enhancement in the durability of the exhaust manifold M.

In addition, the weld zone 24 of the inner collecting pipe shell halves 15*a* and 15*b* and the weld zone 25 of the outer collecting pipe shell halves 16*a* and 16*b* are disposed between the pair of arcuate mesh member pieces 20*a* and 20*b* forming the mesh member 20. Therefore, the mesh member 20 can be easily disposed between the inner and outer collecting pipe shells 15 and 16 while avoiding the interference of the welded ends of the inner collecting pipe shell halves 15*a* and 15*b* with the welded ends of the outer collecting pipe shell halves 16*a* and 16*b*, whereby the relative smooth sliding movement of the inner collecting pipe shells 15 and 16 can be ensured.

Figure 7:
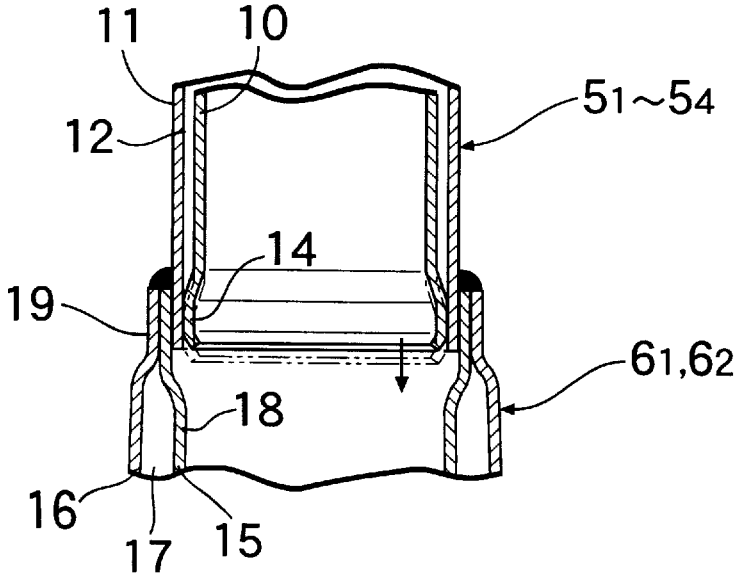
FIG. 7 is a sectional view showing a second embodiment of the present invention.

In a second embodiment of the present invention shown in FIG. 7, the cross-sectional shape of the annular bead 14 formed on an outer peripheral surface of the downstream end of each of inner exhaust pipe shells 10 is trapezoidal. The other parts are similar to those in the previous embodiment and hence, in FIG. 7, portions and components corresponding to those in the previous embodiment are designated by like reference characters, and the description of them is omitted.

Figure 8:
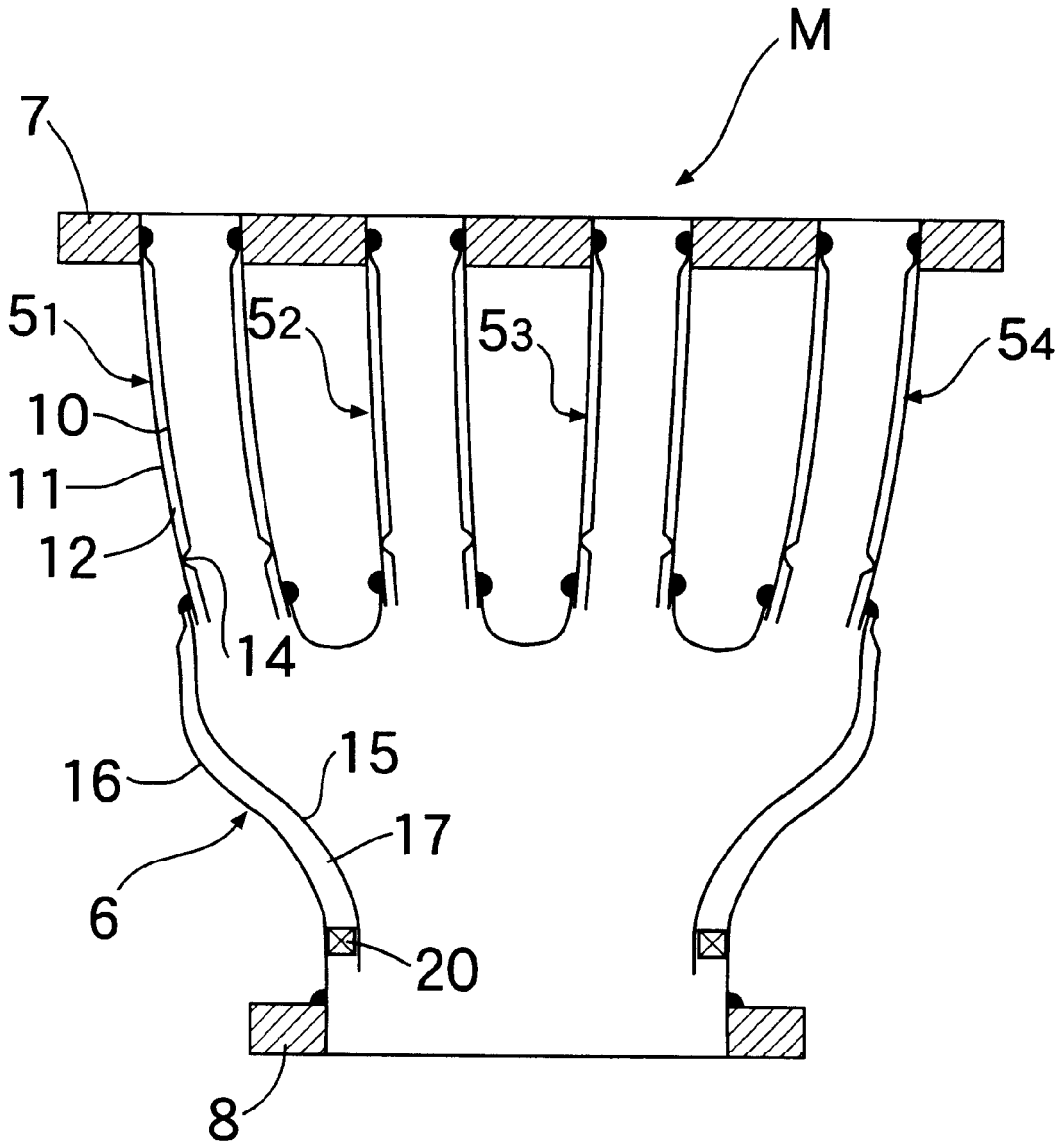
FIG. 8 is a vertical sectional front view of an exhaust manifold according to a third embodiment of the present invention.
Figure 9:
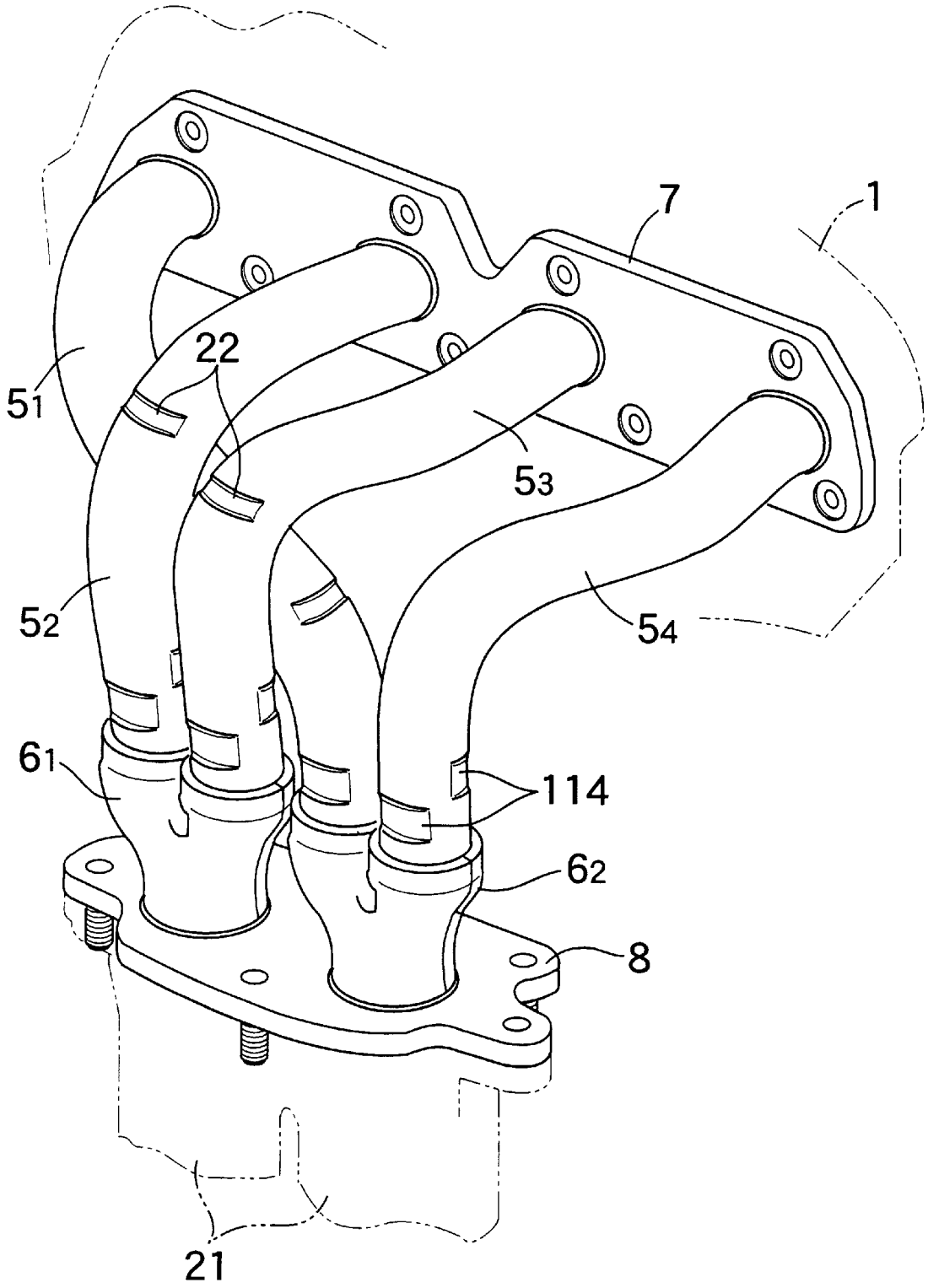
FIG. 9 is a perspective view of a heat-insulation type exhaust manifold according to a fourth embodiment of the present invention.
Figure 10:
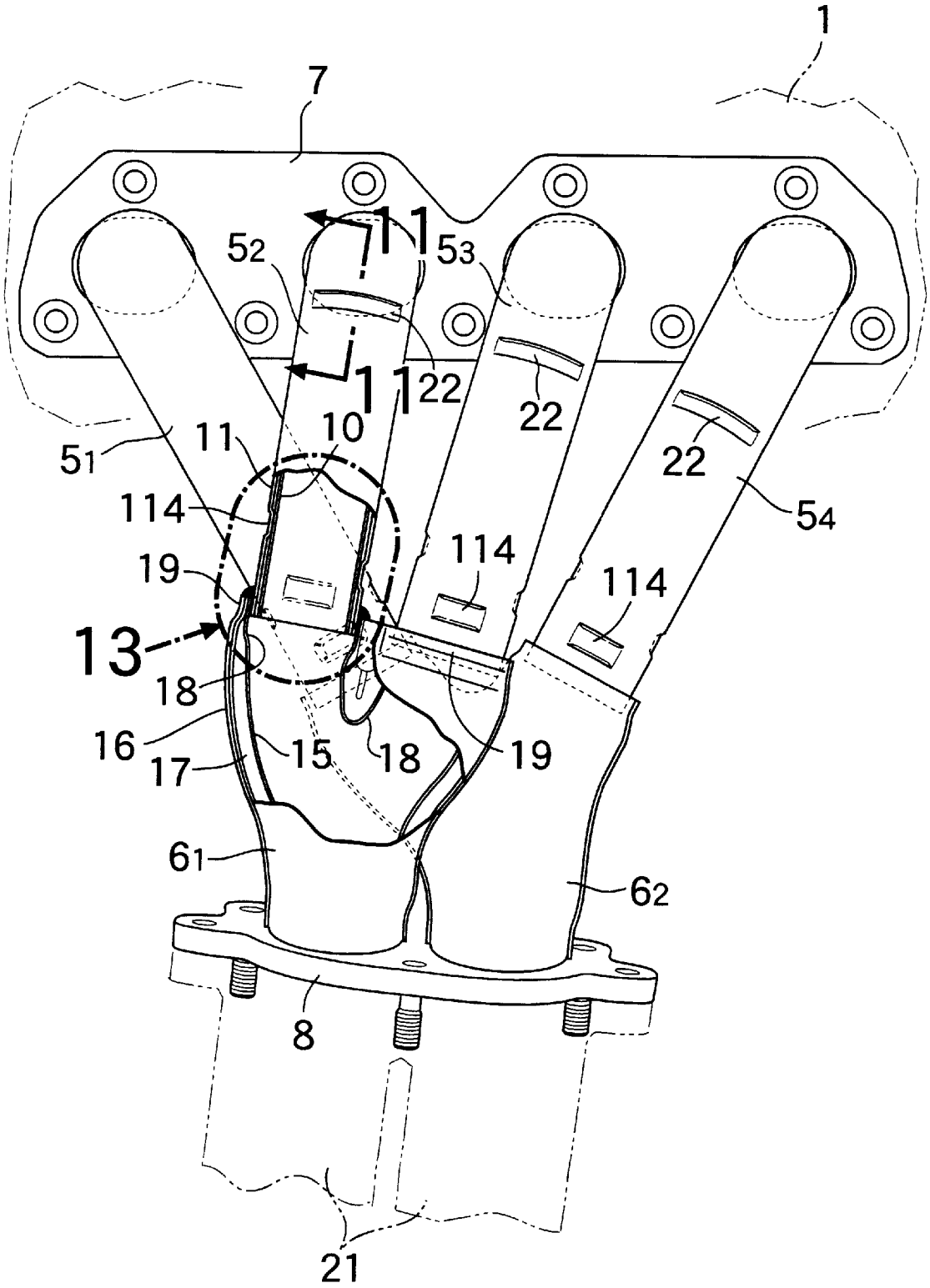
FIG. 10 is a front view of the exhaust manifold with a portion being sectioned vertically in FIG. 9.
Figure 11:
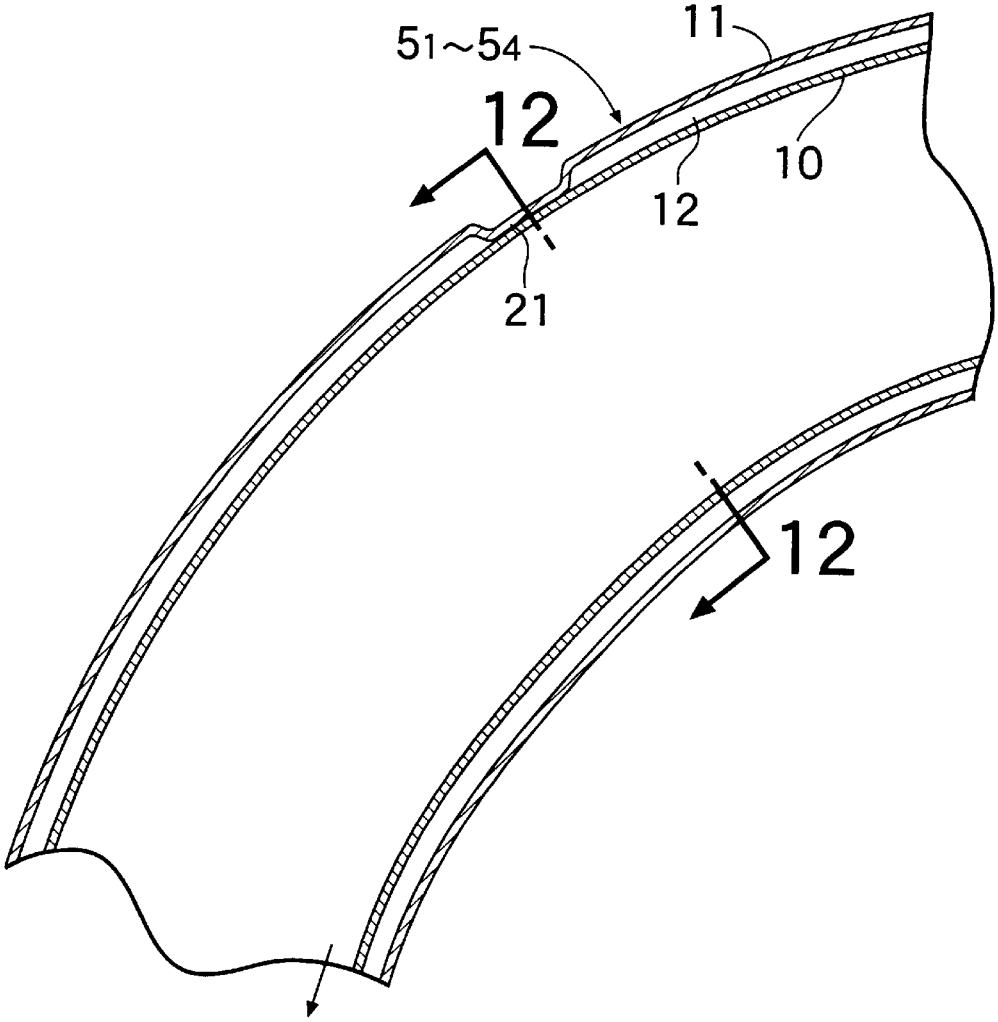
FIG. 11 is a sectional view taken along a line 11—11 in FIG. 10.
Figure 12:
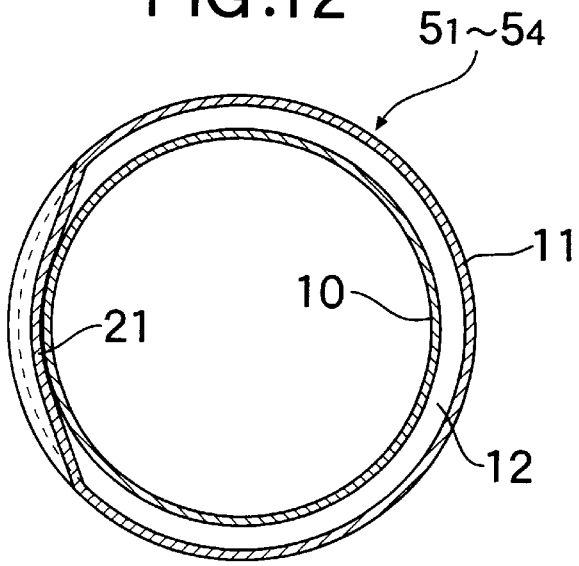
FIG. 12 is a sectional view taken along a line 12—12 in FIG. 11.
Figure 13:
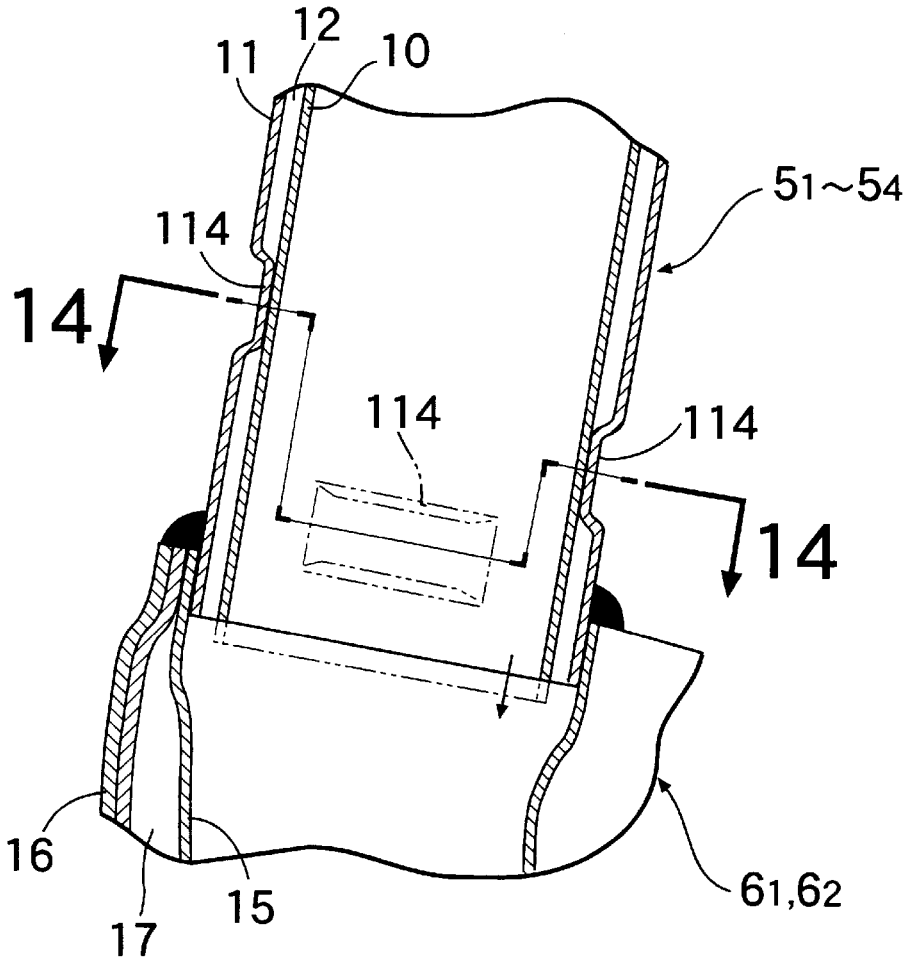
FIG. 13 is an enlarged view of a portion indicated by 13 in FIG. 10.
Figure 14:
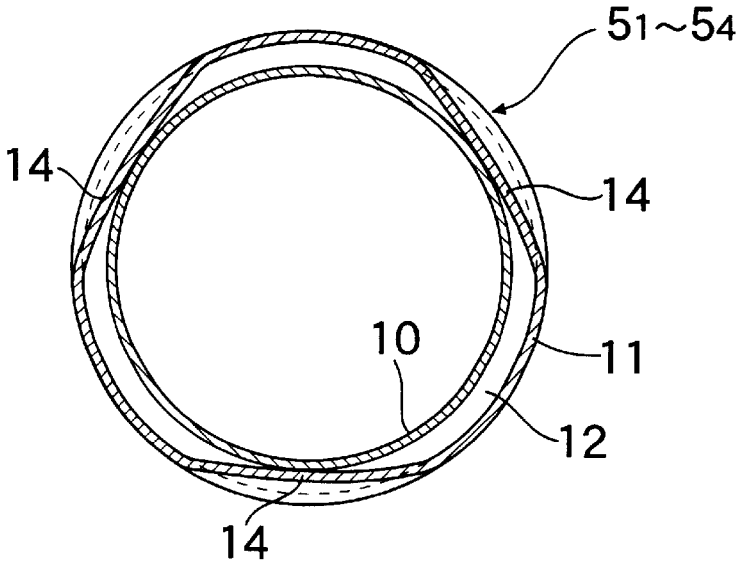
FIG. 14 is a sectional view taken along a line 14—14 in FIG. 13

In a heat-insulation type exhaust manifold M according to a third embodiment of the present invention shown in FIG. 8, a single common exhaust collecting pipe 6 is connected to four exhaust single pipes $5_1$, $5_2$, $5_3$ and $5_4$, and the heat-insulating structure and the thermal elongation absorbing structure are substantially the same as in the first embodiment. In FIG. 8, portions and components corresponding to those in the previous embodiment are designated by like reference characters, and the description of them is omitted.

A fourth embodiment of the present invention will now be described with reference to FIGS. 9 to 14.

At least three (three in the illustrated embodiment) projections 114 are formed at the downstream end of each of the outer exhaust pipe shells 11, so that they are bulged and arranged circumferentially at substantially equal circumferential distances on an inner peripheral surface of the outer exhaust pipe shell 11 by pressing from the side of an outer peripheral surface of the outer exhaust pipe shell 11. In this case, the projections 114 are offset from one another in the axial direction of the outer exhaust pipe shell 11. Therefore, no other projection exists on a circumference of the outer exhaust pipe shell 11 including the projections 114. The downstream end of the inner exhaust pipe shell 10 slidably contacts the projections 114.

In an intermediate bent portion of each of the exhaust single pipes $5_1$ to $5_4$, a projection 22 is formed on the bent outer peripheral wall of the outer exhaust pipe shell 11 and bulged on an inner peripheral surface of the outer exhaust pipe shell 11 by pressing from the outer periphery of the outer exhaust pipe shell 11, and the bent outer peripheral wall of the inner exhaust pipe shell 10 is slidably carried by the projection 22.

Other parts are the same as in the first embodiment and hence, in FIGS. 9 to 14, portions or components corresponding to those in the first embodiment are designated by like reference characters and the description of them is omitted.

Thus, if the inner exhaust pipe shell 10 produces an axial thermal elongation larger than that of the outer exhaust pipe shell 11 in each of the exhaust single pipes due to the influence of heat of the exhaust gas passing through the inside of the exhaust single pipes $\mathbf{5}_1$, $\mathbf{5}_2$, $\mathbf{5}_3$, $\mathbf{5}_4$ during operation of the engine E, the downstream end of the inner exhaust pipe shell 10 slides with such elongation, relative to the three projections arranged circumferentially at substantially equal distances at the downstream end of the outer exhaust pipe shell 11, whereby the difference in axial thermal elongation between the inner and outer exhaust pipe shells 10 and 11 is absorbed and at the same time, a heat-insulating space 12 is ensured between the inner and outer exhaust pipe shells 10 and 11 by the projections 114.

Moreover, since spaces exist between the three projections 114, the difference in axial thermal elongation between the inner and outer exhaust pipe shells 10 and 11 is absorbed into the spaces.

Further, the three projections 114 are disposed, offset from one another in the axial direction of the outer exhaust pipe shell 11, and no other projection 114 exists on the circumference of the outer exhaust pipe shell 11 including the projections 114. Therefore, even if the peripheral wall of the inner exhaust pipe shell 10 is urged by each of the projections 114 during formation of each of the projections 114, the inner exhaust pipe shell 10 can be moved in the urging direction without being restrained by the other projection 114, thereby avoiding the recessed deformation of the peripheral wall of the inner exhaust pipe shell 10 by the projections 114. Therefore, it is possible to prevent a useless increase in resistance to the sliding movement of the inner exhaust pipe shell 10 relative to the projections 114 of the outer exhaust pipe shell 11 to thereby smoothly absorb the difference in axial thermal elongation between the inner and outer exhaust pipe shells 10 and 11.

A fifth embodiment of the present invention will be finally described with reference to FIGS. 15 and 16.

An annular recess 23 is defined in the inner peripheral surface of the downstream end of an outer collecting pipe shell 16. A pair of arcuate mesh member pieces 20*a* and 20*b* which form an annular mesh member 20 are slidably mounted in the annular recess 23, and the downstream end of the inner collecting pipe shell 15 is slidably fitted into the inner peripheral surfaces of the mesh member pieces 20*a* and 20*b*. Even in this case, a weld zone 24 of inner collecting pipe shell halves 15*a* and 15*b* forming an inner collecting pipe shell 15 and a weld zone 25 of outer collecting pipe shell halves 16*a* and 16*b* are disposed between the mesh member halves 20*a* and 20*b*.

Figure 15:
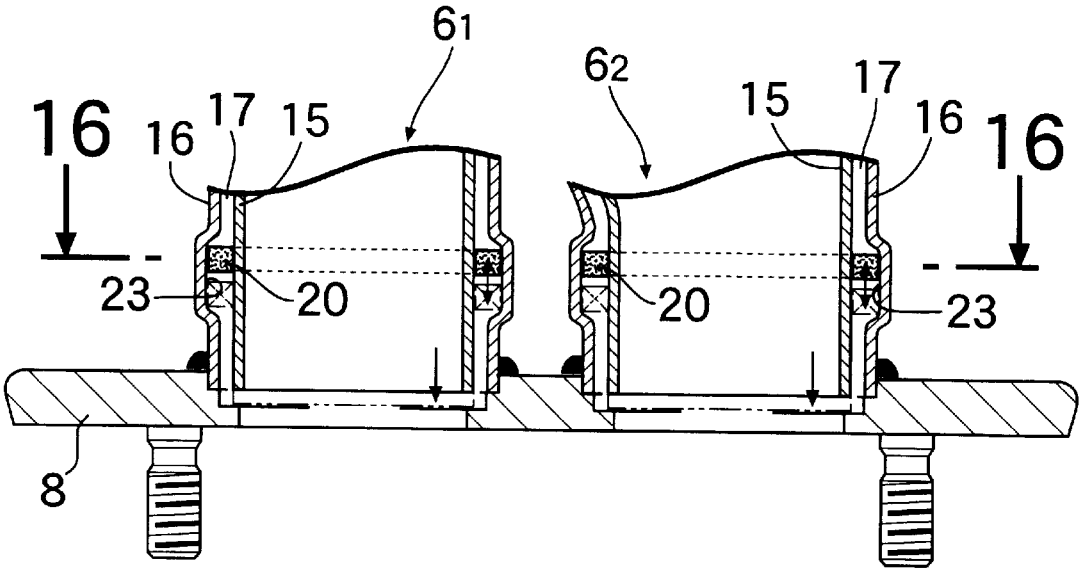
FIG. 15 is a sectional view similar to FIG. 5, but according to a fifth embodiment of the present invention.
Figure 16:
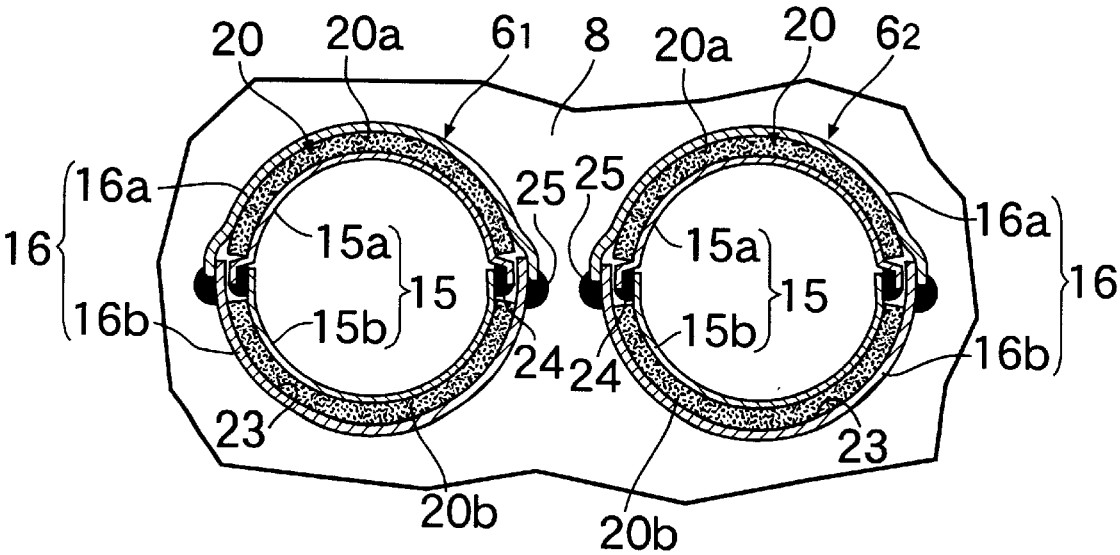
FIG. 16 is a sectional view taken along a line 16—16 in FIG. 15.

Other parts are the same as in the first embodiment and hence, in FIGS. 15 and 16, portions or components corresponding to those in the first embodiment are designated by like reference characters and the description of them is omitted.

The annular mesh member 20 has inner and outer peripheral surfaces both of which serve as slide surfaces. Therefore, when a difference in axial thermal elongation is produced between the inner and outer exhaust pipe shells 10 and 11, the inner exhaust pipe shell 10 and the mesh member 20, as well as the outer exhaust pipe shell 11 and the mesh member 20 slide relative to each other, whereby the difference in axial thermal elongation can be absorbed. Therefore, even if one of the inner and outer peripheral surfaces of the mesh member 20 fails to slid due to biting of foreign matter or the like, the absorption of the difference in axial thermal elongation can be carried out without hindrance by the sliding movement of the other of the inner and outer peripheral surfaces, thereby providing an enhancement in durability of the exhaust manifold M.

Moreover, when both the inner and outer peripheral surfaces of the mesh member 20 slide normally, the absorption of the difference in axial thermal elongation between the inner and outer exhaust pipe shells 10 and 11 is shared by the inner and outer peripheral surfaces of the mesh member 20. Therefore, the amount of sliding movement of each of the sliding portions is reduced by half, as compared with a conventional structure where only one sliding portion is provided, thereby providing an enhancement in durability of the mesh member 20. The movement of the mesh member 20 more than required is limited by the end face of an annular recess 23 of the outer exhaust pipe shell 11.

The mesh member 20 can be easily mounted to the outer collecting pipe shell 16 by sequentially inserting a pair of mesh member halves 20*a* and 20*b* forming the mesh member 20. Moreover, the weld zone 24 protruding outwards from the inner collecting pipe shell halves 15*a* and 15*b* is disposed between both the mesh member pieces 20*a* and 20*b* and hence, the interference of the weld zone 24 with the mesh member 20 can be avoided, and the useless rotation of each of the mesh member pieces 20*a* and 20*b* can be restrained.

The number and shape of the exhaust simple pipes and the exhaust collecting pipes can be freely selected depending upon the number of cylinders of the engine and the shape of the engine. A heat insulating material may be filled in each of the heat-insulating spaces 12 and 17. Although the embodiments of the present invention have been described in detail, it will be understood that the present invention is not limited, and various modifications in design may be made without departing from the spirit and scope of the invention defined in claims.

What is claimed is:

1. A heat-insulation type exhaust manifold for an engine, comprising an upper flange, a plurality of exhaust single pipes coupled at the upstream ends thereof to said upper flange, at lease one exhaust collecting pipe coupled to the downstream ends of at least two of said exhaust single pipes, and a lower flange coupled to the downstream end of said at least one exhaust collecting pipe, each of said exhaust single pipes and said at least one exhaust collecting pipe being formed in a double-wall structure, wherein each of said exhaust single pipes is comprised of an inner exhaust pipe shell and an outer exhaust pipe shell, said inner exhaust pipe shell being disposed within said outer exhaust pipe shell, the upstream ends of said inner and outer exhaust pipe shells being coupled to each other and to said upper flange, said inner exhaust pipe shell being in slidable contact with, at its downstream end, an inner peripheral surface of said outer exhaust pipe shell; and each of said at lease one exhaust collecting pipe comprising an inner collecting pipe shell communicating with the plurality of inner exhaust pipe shells, and an outer collecting pipe shell covering said inner collecting pipe shell, the upstream ends of said inner and outer collecting pipe shells being coupled to each other and to outer peripheral surfaces of the plurality of said outer exhaust pipe shells, said inner collecting pipe shell being slidably carried at the downstream end thereof with an inner peripheral surface of said outer collecting pipe shell; and wherein said lower flange is coupled to a downstream end of said outer collecting pipe shell.

2. A heat-insulation type exhaust manifold for an engine according to claim 1, wherein said inner exhaust pipe shell has an annular projection formed at the downstream end thereof, said annular projection bulging from an outer peripheral surface of said downstream end and slidably contacting the inner peripheral surface of the corresponding outer exhaust pipe shell.

3. A heat-insulation type exhaust manifold for an engine according to claim 2, wherein said annular projection is an annular bead having an increased diameter bulging from the outer peripheral surface of said inner exhaust pipe shell.

4. A heat-insulation type exhaust manifold for an engine according to claim 3, wherein the cross-sectional shape of the annular bead is arcuate.

5. A heat-insulation type exhaust manifold for an engine according to claim 3, wherein the cross-sectional shape of the annular bead is trapezoidal.

6. A heat-insulation type exhaust manifold for an engine according to claim 1, wherein said outer exhaust pipe shell has a projection formed on the downstream end thereof and at a location upstream of a portion of the outer exhaust pipe shell which is coupled with said upstream ends of said inner and outer collecting pipe shells, said projection bulging from an inner peripheral surface of said downstream end of the outer exhaust pipe shell to contact the outer peripheral surface of the corresponding inner exhaust pipe, for enabling sliding movement between said inner and outer exhaust pipe shells.

7. A heat-insulation type exhaust manifold for an engine according to claim 6, wherein the number of said projections is at least three, said at least three projections being arranged at substantially equal distances circumferentially around said outer exhaust pipe shell.

8. A heat-insulation type exhaust manifold for an engine according to claim 7, wherein said at least three projections are disposed offset from one another, in the axial direction of said outer exhaust pipe shell.

9. A heat-insulation type exhaust manifold for an engine according to claim 6, wherein said outer exhaust pipe shell has a projection formed on a bent outer peripheral wall in an intermediate bent portion thereof, said projection bulging from an inner surface of said outer peripheral wall to contact a bent outer peripheral surface of an intermediate bent portion of the corresponding inner exhaust pipe shell for enabling sliding movement between said inner and outer exhaust pipe shells.

10. A heat-insulation type exhaust manifold for an engine according to claim 1, including a mesh member, wherein the downstream end of said inner collecting pipe shell being slidably carried on the inner peripheral surface of said outer collecting pipe shell with said mesh member interposed therebetween.

11. A heat-insulation type exhaust manifold for an engine according to claim 10, wherein said mesh member is bonded to an outer peripheral surface of the downstream end of said inner collecting pipe shell.

12. A heat-insulation type exhaust manifold for an engine according to claim 10, wherein said annular mesh member is slidably mounted in an annular recess defined in the inner peripheral surface of the is downstream end of said outer collecting pipe shell, and contacts an outer peripheral surface of said inner collecting pipe shell for sliding movement therebetween.

13. A heat-insulation type exhaust manifold for an engine according to claim 10, wherein said inner collecting pipe shell comprises a pair of inner collecting pipe shell halves bonded to each other at their opposed ends, and said mesh member comprises a pair of arcuate mesh member pieces disposed annularly out of contact with the bonded ends of said inner collecting pipe shell halves.

* * * * *

UNITED STATES PATENT AND TRADEMARK OFFICE

CERTIFICATE OF CORRECTION

PATENT NO. : 6,155,046
DATED : December 5, 2000
INVENTOR(S) : Seiji Kato et al.

It is certified that error appears in the above-identified patent and that said Letters Patent is hereby corrected as shown below:

Title page,
Item [73], after "Honda Giken Kogyo Kabushiki Kaisha, Tokyo, Japan" insert -- Yutaka Giken Co., Hamamatsu-shi, Japan --.

Signed and Sealed this

Fifth Day of February, 2002

*Attest:*

*Attesting Officer*

JAMES E. ROGAN
*Director of the United States Patent and Trademark Office*